US005924879A

United States Patent [19]

Kameyama

[11] Patent Number: 5,924,879

[45] Date of Patent: Jul. 20, 1999

[54] OPPOSED-CONTACT CONNECTOR WITH SLIDABLE CONTACT COVER

[75] Inventor: Isao Kameyama, Shizuoka, Japan

[73] Assignee: Yazaki Corporation, Tokyo, Japan

[21] Appl. No.: 08/877,625

[22] Filed: Jun. 18, 1997

[30] Foreign Application Priority Data

Jun. 24, 1996 [JP] Japan ..... 8-163242

[51] Int. Cl.[6] ..... H01R 13/453

[52] U.S. Cl. ..... 439/141; 439/557; 439/289

[58] Field of Search ..... 439/140, 141, 439/595, 557, 289

[56] References Cited

U.S. PATENT DOCUMENTS

| | | | |
|---|---|---|---|
| 3,747,047 | 7/1973 | Carter et al. | 439/141 |
| 4,140,358 | 2/1979 | Marechal | 439/319 |
| 4,797,116 | 1/1989 | Isohata et al. | 439/141 |

*Primary Examiner*—Neil Abrams

*Attorney, Agent, or Firm*—Sughrue, Mion, Zinn, Macpeak & Seas, PLLC

[57] ABSTRACT

An opposed-contact connector (11) in which terminal contacts are prevented from projecting from the connector except when they are to be electrically contacted with their respective mating electrodes, and the terminal contacts can be projected to have an appropriate contact pressure only when they are electrically contacted with the mating electrodes, respectively. The opposed-contact connector (11) includes a housing (13), terminals (51) received in the housing in such a manner that contacts (53) of the terminals project from a front portion of the housing, a spacer (15) slidably mounted on the front portion of the housing so as to enclose the contacts, and a spacer provisionally-retaining device (27,39) provided between the spacer and the housing, and before the housing is mounted on a mounting member (55), the spacer is provisionally retained on the housing by said retaining device in such a manner that the spacer encloses the contacts, and when mounting the housing on the mounting member, the retaining device releases the provisionally-retained condition, and allows the spacer to slide.

6 Claims, 9 Drawing Sheets

OPPOSED-CONTACT CONNECTOR WITH SLIDABLE CONTACT COVER

BACKGROUND OF THE INVENTION

1. Field of the Invention

This invention relates to an opposed-contact connector having terminals mounted in and projecting from a housing.

2. Background

There is known an opposed contact-type connector having terminals mounted in and projecting from a housing. FIG. 15 is a cross-sectional view of a conventional opposed-contact connector, and FIG. 16 is a cross-sectional view showing a condition in which the opposed-contact connector of FIG. 15 is electrically contacted with a battery. For example, the opposed-contact connector 1 is often used as a device for contact with battery-charging electrodes, and terminal contacts 3 project from a housing 5 so that they can electrically contact recessed battery electrodes, respectively.

When the battery 7 and the opposed-contact connector 1 are set in position in opposed relation to each other to achieve electrical contact, the projecting terminal contact 3 is pressed by the battery electrode 9, and is resiliently deformed within the housing 5, so that the terminal contact 3 is held in electrical contact with the battery electrode 9 under an appropriate pressure produced by a resilient restoring force of the terminal contact 3.

In the above conventional opposed-contact connector 1, however, the terminal contact 3 is projected from the housing 5 in an exposed manner so that it can contact the recessed electrode 9, and therefore there are occasions when the terminal contact 3 interferes with other member to be deformed. And besides, since the terminal contact 3 is projected, the hand grease, dust and so on adhere to the terminal contact 3, and the terminal contact 3 is subjected to corrosion due to the adherence of such foreign matter, and as a result there is a possibility that the electrical contact is adversely affected. Furthermore, when a relatively high voltage is applied to the terminals, there is a possibility that adverse effects are exerted on the human body.

SUMMARY OF THE INVENTION

With the above problems in view, it is an object of this invention to provide an opposed-contact connector in which terminal contacts are prevented from projecting from the connector except when they are to be electrically contacted with their respective mating electrodes, and the terminal contacts can be projected to have an appropriate contact pressure only when they are electrically contacted with the mating electrodes, respectively, thereby protecting the terminals and also enhancing the reliability of the electrical contact and the safety.

The above object of the invention has been achieved by an opposed-contact connector including: a housing; terminals received in the housing in such a manner that contacts of the terminals project from a front portion of the housing; a spacer slidably mounted on the front portion of the housing so as to enclose the contacts; and a spacer provisionally-retaining device provided between the spacer and the housing, wherein before the housing is mounted on a mounting member, the spacer is provisionally retained on the housing by the retaining device in such a manner that the spacer encloses the contacts, and when mounting the housing on the mounting member, the retaining device releases the provisionally-retained condition, and allows the spacer to slide.

In the opposed-contact connector of this construction, when the housing is not mounted on the mounting member, the spacer is provisionally retained on the housing by the spacer provisionally-retaining device, and the terminals, projecting from the housing, are covered with the spacer. On the other hand, when the housing is mounted on the mounting member, the condition of provisionally retaining of the spacer on the housing by the spacer provisionally-retaining device is released, and the spacer slides relative to the housing, and the terminals are projected from the housing so as to contact mating electrode, respectively.

DETAILED DESCRIPTION OF THE PREFERRED EMBODIMENT

A preferred embodiment of an opposed-contact connector of the present invention will now be described in detail with reference to the drawings.

Figure 1:
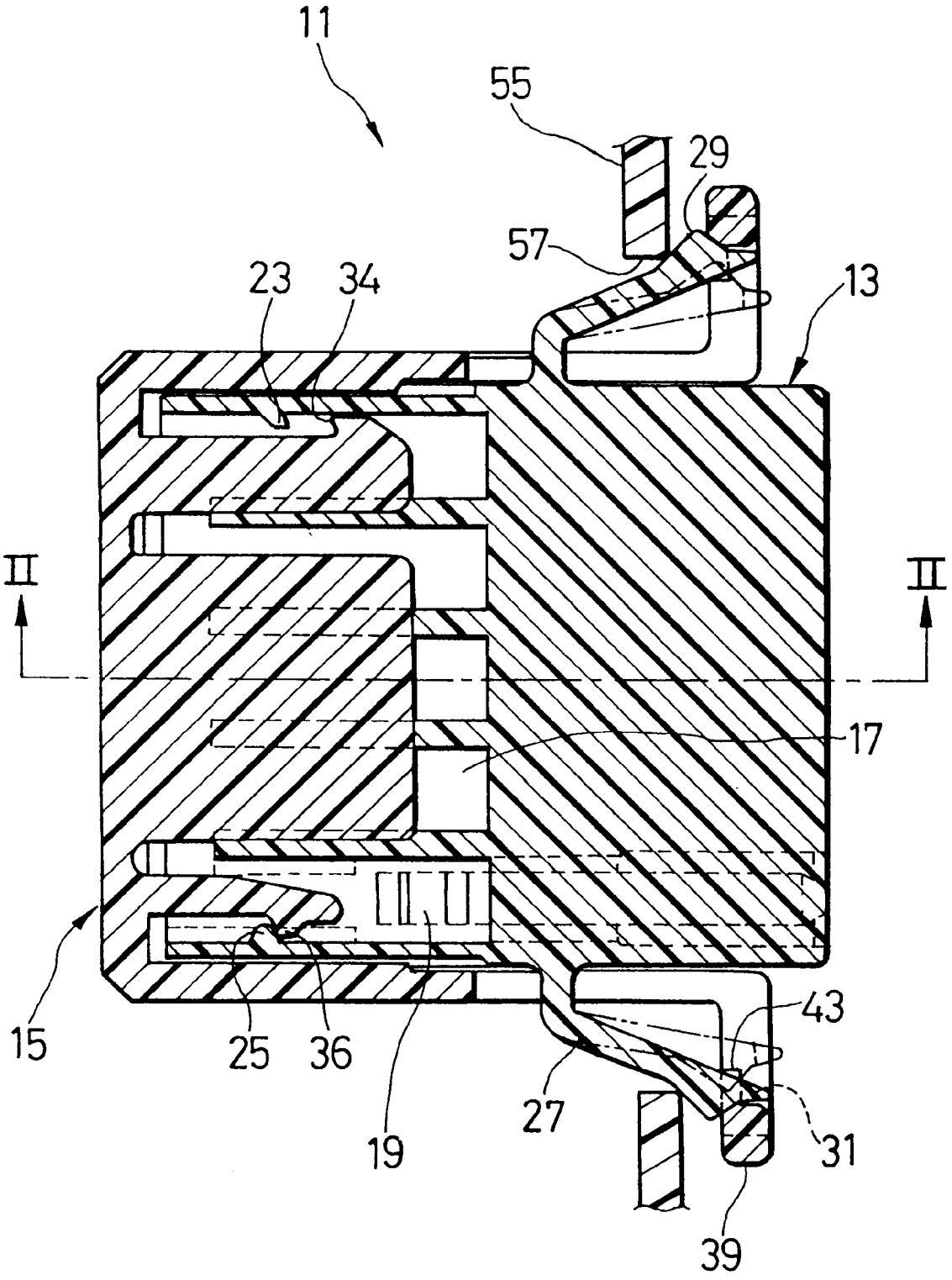
FIG. 1 is a cross-sectional view showing a provisionally-retained condition of an opposed-contact connector of the invention.
Figure 3:
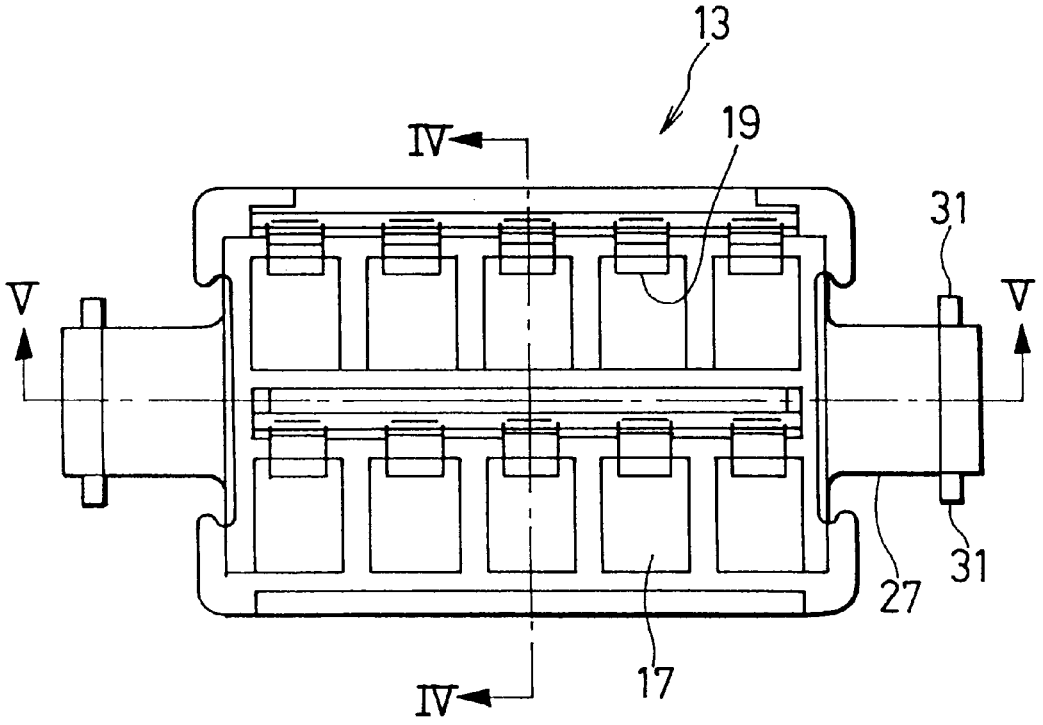
FIG. 3 is a front-elevational view of a housing shown in FIG. 1.
Figure 4:
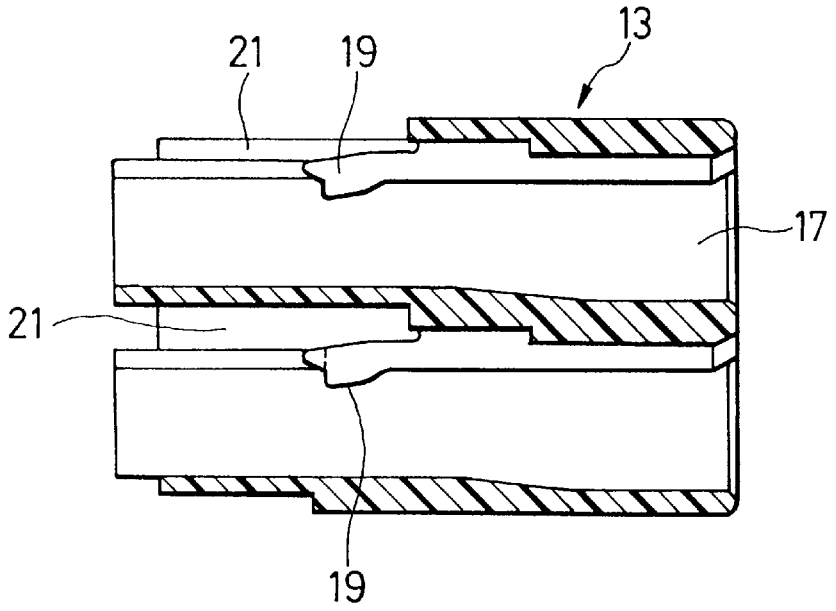
FIG. 4 is a view as seen along the line IV—IV of FIG. 3.

As shown in FIG. 1, an opposed-contact connector 11 of this embodiment includes a housing 13, and a spacer 15 slidably attached to a front portion of the housing 13. As shown in FIG. 3, the housing 13 has, for example, two rows (upper and lower rows) of juxtaposed terminal receiving chambers 17. As shown in FIG. 4, a lance (elastic retaining piece portion) 19 for retaining the terminal is provided in each of the terminal receiving chambers 17. A space is formed on that side of the lances 19 facing away from each row of terminal receiving chambers 17, and this space serves as a receiving portion 21 for receiving an insertion plate (described later) of the spacer 15.

Figure 5:
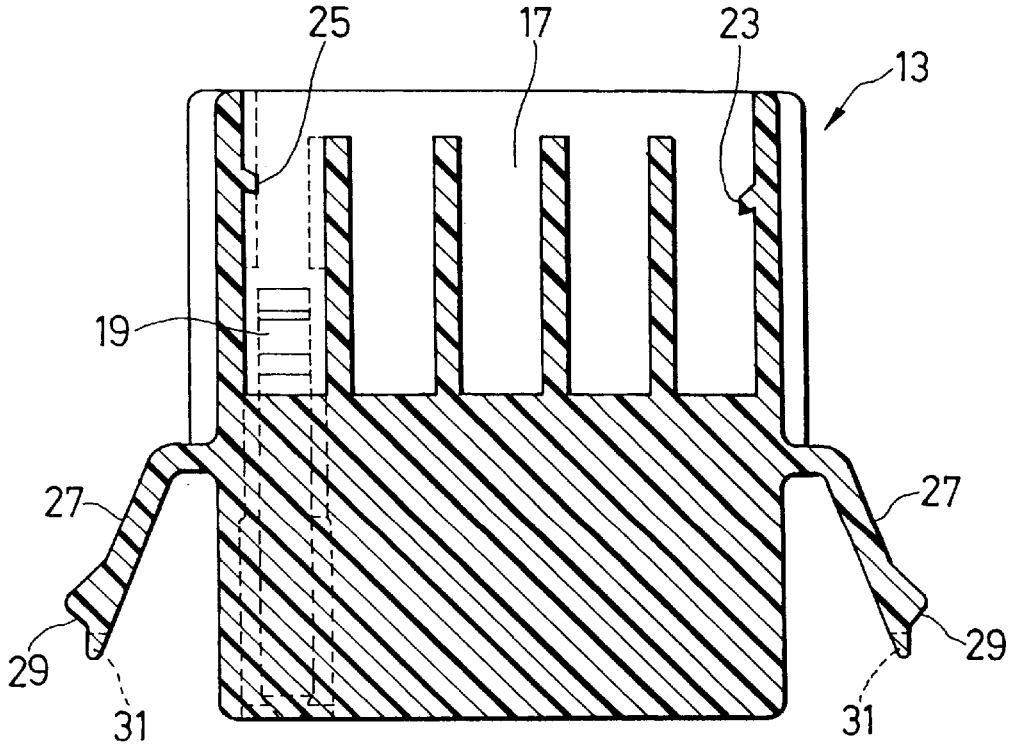
FIG. 5 is a view as seen along the line V—V of FIG. 3.

As shown in FIG. 5, a first retaining pawl 23 and a second retaining pawl 25 are formed respectively on opposed inner surfaces of the housing 13. The first and second retaining pawls 23 and 25 are retainingly engaged respectively with retaining pawls (described later) of the spacer 15. A pair of elastic legs 27 are formed respectively on opposite side walls (right and left side walls in FIG. 5) of the housing 13, and the elastic legs 27 are integrally connected at their proximal ends respectively to the opposite side walls, and spread away from each other toward their distal ends which are directed downwardly. A fixing pawl 29 is formed on the outer surface of each elastic leg 27, and these fixing pawls 29 serve to retain the housing 13 on a mounting member (described later). The elastic leg 27 is in the form of a strip-like plate having a predetermined width, and has a pair of projections 31 projecting respectively from opposite edges (upper and lower edges in FIG. 3) of the lower end of the elastic leg 27. The pair of projections 31 engage a fixing leg (described later) of the spacer 15 to limit the movement of the spacer 15 relative to the housing 13.

Figure 6:
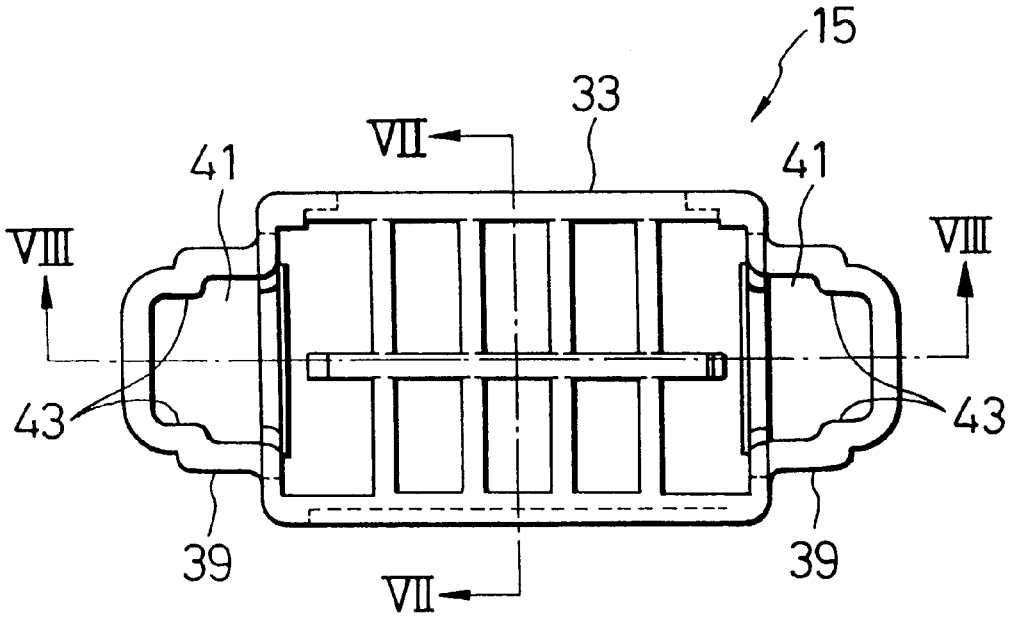
FIG. 6 is a front-elevational view of a spacer shown in FIG. 1.
Figure 7:
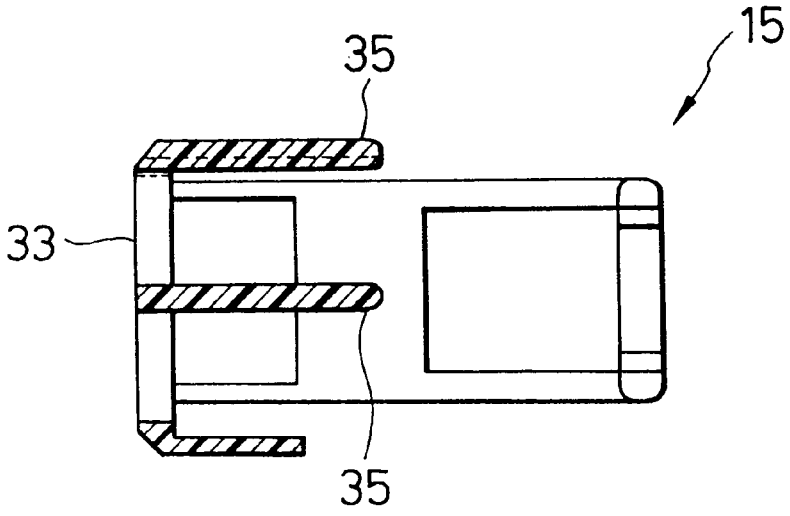
FIG. 7 is a view as seen along the line VII—VII of FIG. 6.
Figure 8:
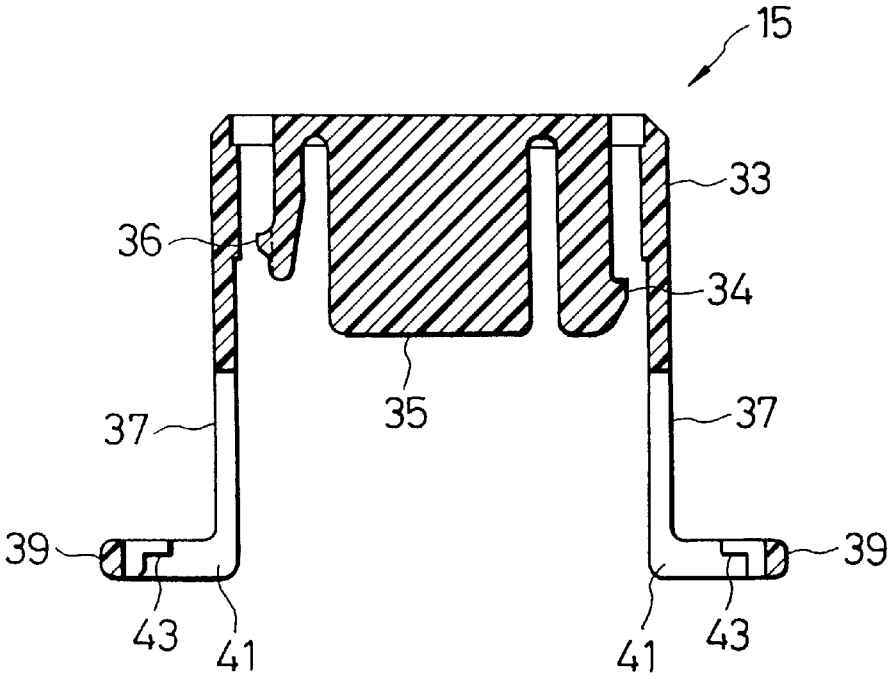
FIG. 8 is a view as seen along the line VIII—VIII of FIG. 6.

As shown in FIG. 6, the spacer 15 has a hood portion 33 for slidably fitting on the front portion of the housing 13. As shown in FIG. 7, the insertion plate 35, corresponding to the associated row of terminal receiving chambers 17 in the housing 13, is provided within the hood portion 33, and the insertion plate 35 can be inserted into the receiving portion 21 in the housing 13. As shown in FIG. 8, a third retaining pawl 34 and a fourth retaining pawl 36 are provided within the hood portion 33, and extend in the same direction as the direction of extending of the insertion plate 35. The third retaining pawl 34 can be retainingly engaged with the first retaining pawl 23 of the housing 13 whereas the fourth retaining pawl 36 can be retainingly engaged with the second retaining pawl 25 of the housing 13.

The fixing legs 37 are formed respectively on opposite side walls (right and left walls in FIG. 8) of the spacer 15, and a lower end portion of each fixing leg 37 is bent outwardly into an L-shape. A fixing portion 39 of the fixing leg 37 is formed into a frame-like configuration having a through hole 41 (see FIG. 6). The spacer 15 is fitted on the front portion of the housing 13, with the elastic legs 27 of the housing 13 received respectively in the through holes 41 of the fixing portions 39. As shown in FIG. 6, the width of the through hole 41 is narrowed at its end portion to provide stoppers 43 of a stepped shape, and the stoppers 43 can engage the projections 31 of the elastic leg 27, respectively.

Figure 9:
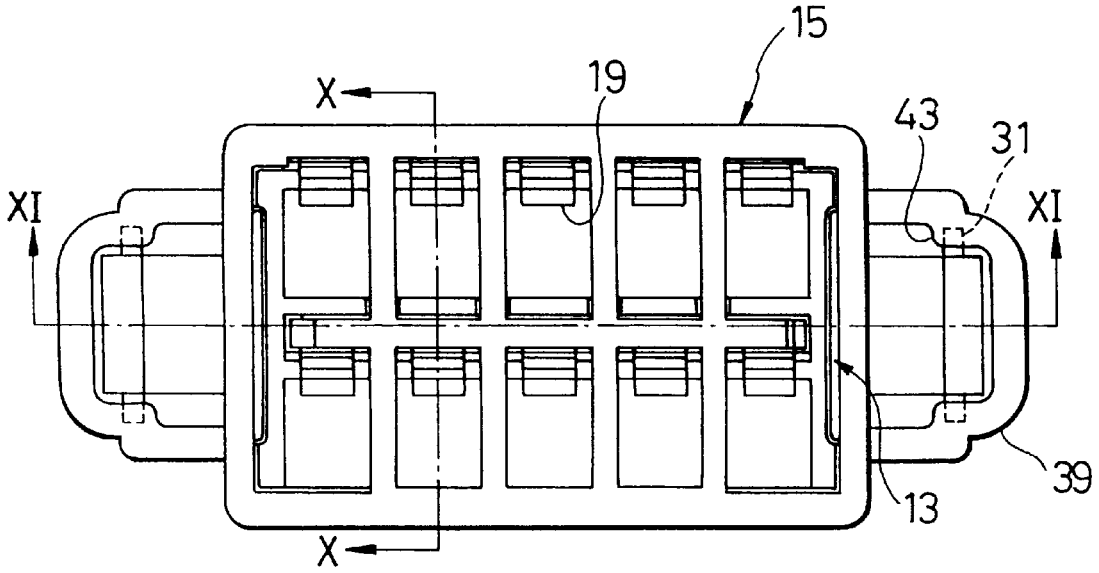
FIG. 9 is a front-elevational view showing a provisionally-attached condition of the opposed-contact connector of the invention.

The spacer 15 is provisionally attached to the housing 13 as shown in FIG. 9, and more specifically the spacer 15 is attached to the front portion of the housing 13. In the provisionally-attached condition, each insertion plate 35 of the spacer 15 is inserted halfway into the associated receiving portion 21 in the housing 13, as shown in FIG. 9. In this condition, the insertion plate 35 does not reach the lances 19, so that the lances 19 can move toward the receiving portion 21.

Figure 11:
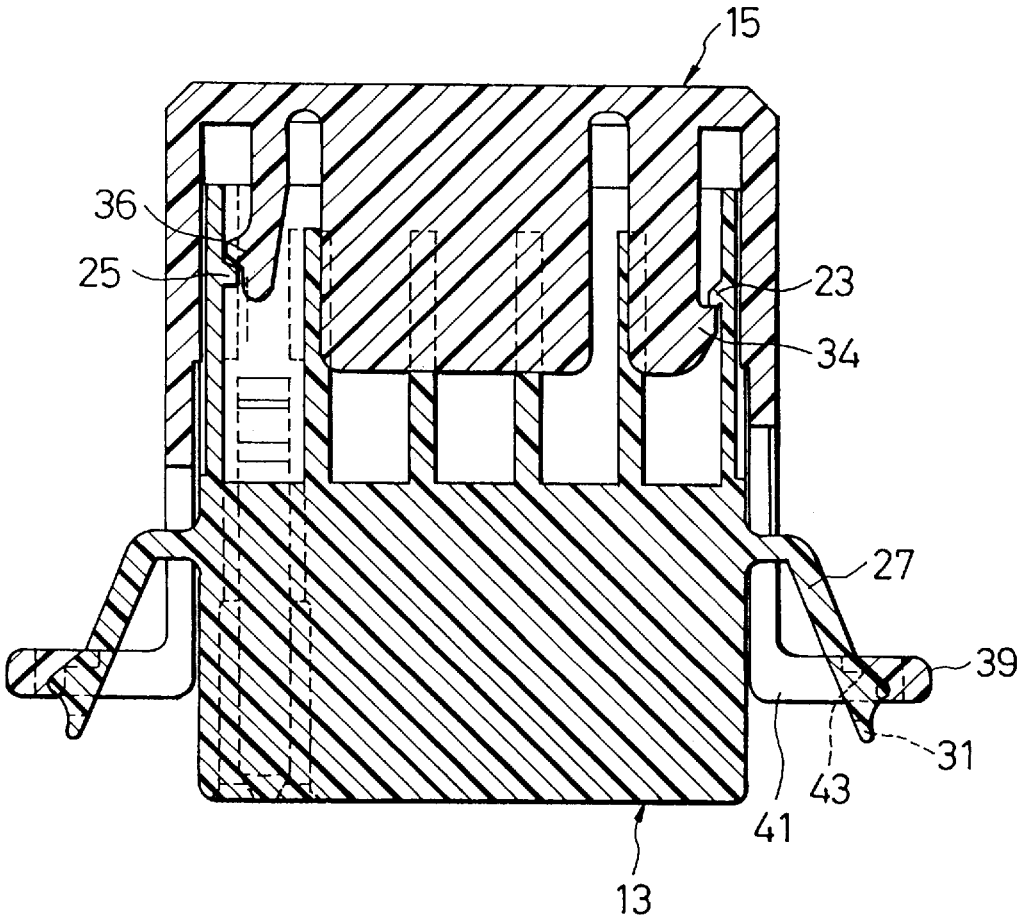
FIG. 11 is a view as seen along the line XI—XI of FIG. 9.

In the provisionally-attached condition, the third and fourth retaining pawls 34 and 36, formed on the spacer 15, are retainingly engaged with the first and second retaining pawls 23 and 25 formed on the housing 13, so that the spacer 15 is kept retained relative to the housing 13, as shown in FIG. 11. In this condition, the elastic legs 27 of the housing 13 are received respectively in the through holes 41 of the fixing legs 37 of the spacer. In this condition, the projections 31 of each elastic leg 27 are spaced respectively from the stoppers 43 of the fixing leg 37, as shown in FIG. 11.

Figure 2:
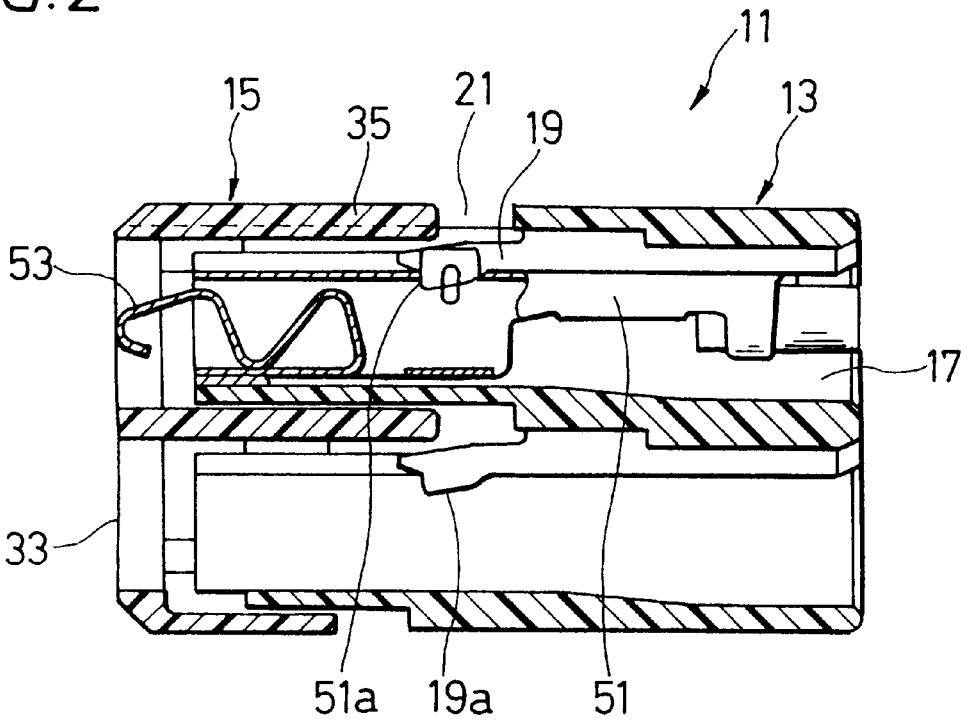
FIG. 2 is a view as seen along the line II—II of FIG. 1, showing a condition in which a terminal is mounted in the opposed-contact connector.

In this condition, the terminals 51 are mounted on the housing 13, as shown in FIG. 2. When the terminal 51 is inserted into the terminal receiving chamber 17 from the rear end (right side in FIG. 2) of the housing 13, the lance 19 is once moved into the receiving portion 21, and when the terminal 51 is inserted into a predetermined position, the lance 19 is elastically restored, and its pawl portion 19*a* is engaged in a retaining hole 51*a* in the terminal 51, thereby retaining the terminal 51 against withdrawal. Therefore, when the terminal 51 is completely retained, the lance 19 is held out of the receiving portion 21.

In this condition of the opposed-contact connector 11, the stoppers 43 are kept in a provisionally-retained condition. In the provisionally-retained condition, when the spacer 15 is pushed toward the housing 13, the fourth retaining pawl 36 of the spacer 15 slides past the second retaining pawl 25 of the housing 13, so that the opposed-contact connector 11 is brought into a condition shown in FIG. 1. After the retaining engagement of the fourth retaining pawl 36 with the second retaining pawl 25 is released, the stoppers 43, formed on each fixing portion 39 of the spacer, engage the projections 31 of the elastic leg 27. Accordingly, the spacer 15 is prevented from further sliding movement, and therefore is held in a provisionally-retained condition.

Figure 10:
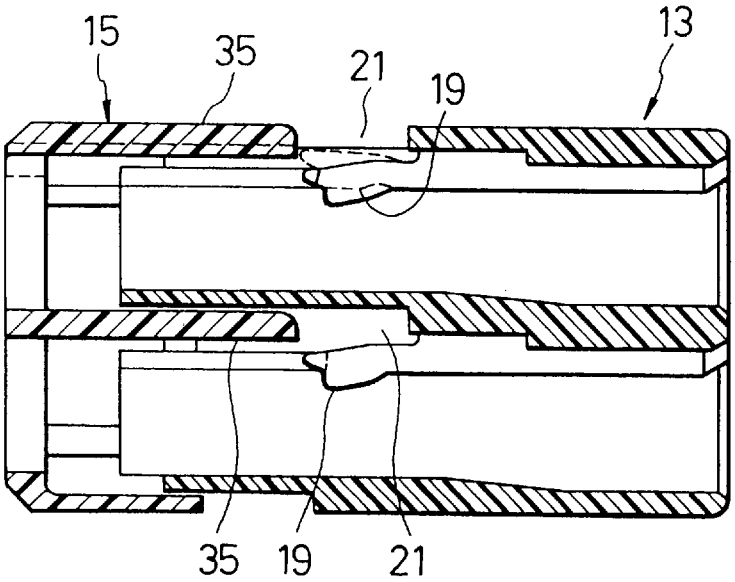
FIG. 10 is a view as seen along the line X—X of FIG. 9.

In this provisionally-retained condition, a contact 53 of the terminal 51 is received within the hood portion 33 of the spacer 15, as shown in FIG. 2. If the terminal 51 is in an incompletely-retained condition during the sliding movement of the spacer 15 into this provisionally-retained condition, the lance 19 is kept projected into the receiving portion 21 as indicated in broken lines in FIG. 10, and the insertion plate 35 of the spacer 15 abuts against the lance 19, so that the spacer 15 is prevented from advancing. Therefore, the incompletely-retained condition of the terminal 51 is detected.

In this provisionally-retained condition, the opposed-contact connector 11 is transported, or fed to an assembling line or the like. Namely, the terminals 51, received in the hood portion 33 of the spacer 15, are not projected, and therefore will not interfere with other member.

Next, the operation of the opposed-contact connector 11 of this construction will be described with reference to FIGS. 12 to 14. The opposed-contact connector 11 in the provisionally-retained condition is inserted into a connector mounting hole 57, formed through the mounting member (for example, an instrument panel) 55 from the reverse side thereof.

When the opposed-contact connector 11 is inserted into the connector mounting hole 57, the fixing pawls 29 of the housing 13 engage the edge of the connector mounting hole 57, so that the elastic legs 27 are elastically deformed toward each other as indicated in broken lines in FIG. 1. Accordingly, the projections 31, formed at the lower end of each elastic leg 27, are disengaged respectively from the stopper portions 43 of the fixing leg of the spacer, so that the spacer 15 and the housing 13 can slide relative to each other.

Figure 12:
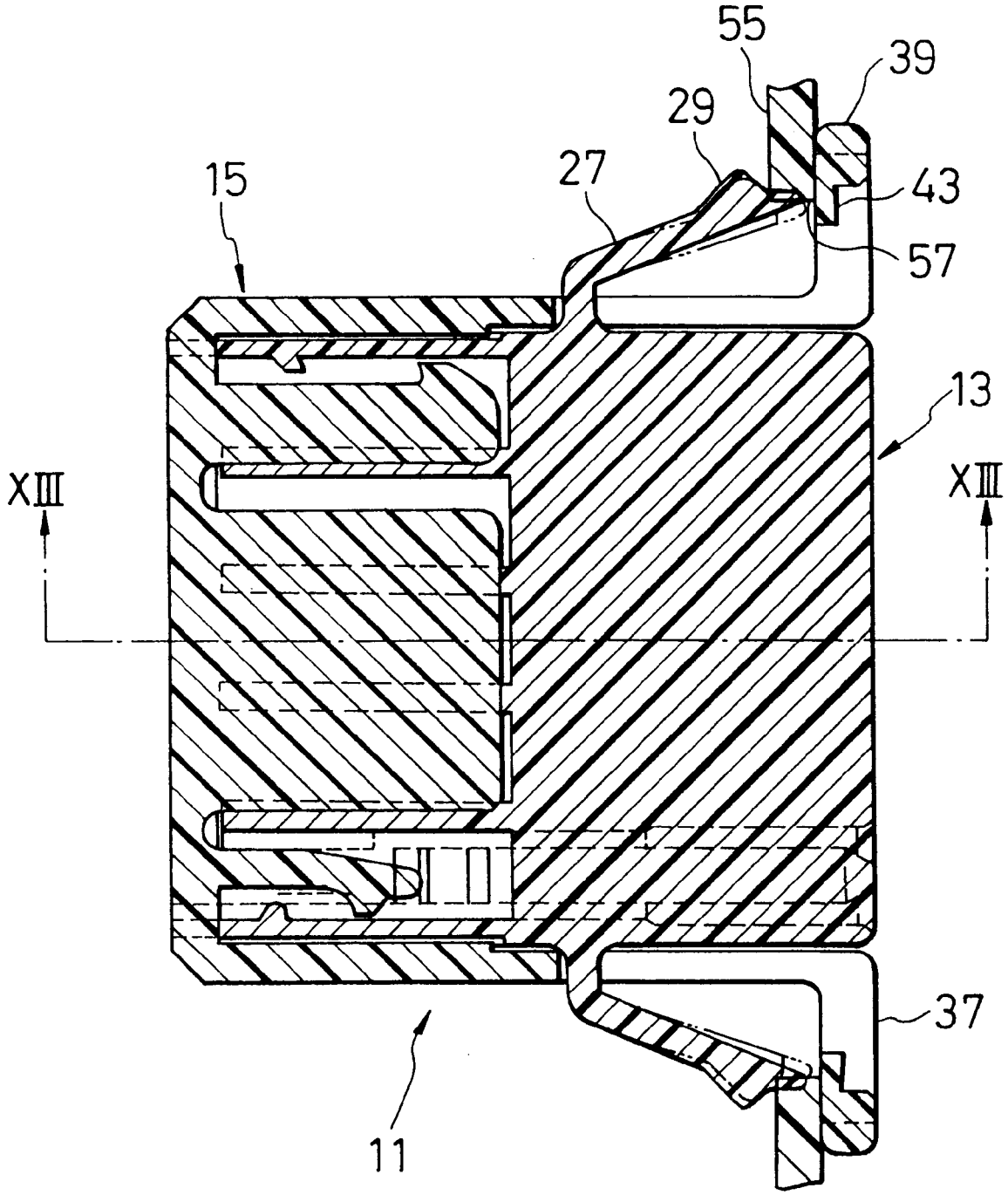
FIG. 12 is a cross-sectional view showing the opposed-contact connector completely retained on the mounting member.

The housing 13, thus rendered slidable, is further pushed from the reverse side of the instrument panel 55, and the elastic legs 27 are passed through the connector mounting hole 57, and are spread away from each other because of their elastic restoring force, so that the fixing pawls 29 are retainingly engaged with the edge of the connector mounting hole on the front side of the instrument panel, as shown in FIG. 12. At the same time, the fixing portions 39 of the fixing legs 37 of the spacer 15 are abutted against the reserve side of the instrument panel 55. Thus, the opposed-contact connector 11 is fixed to the instrument panel 55 in such a manner that the instrument panel 55 is held between the elastic legs 27 and the fixing legs 37.

Figure 13:
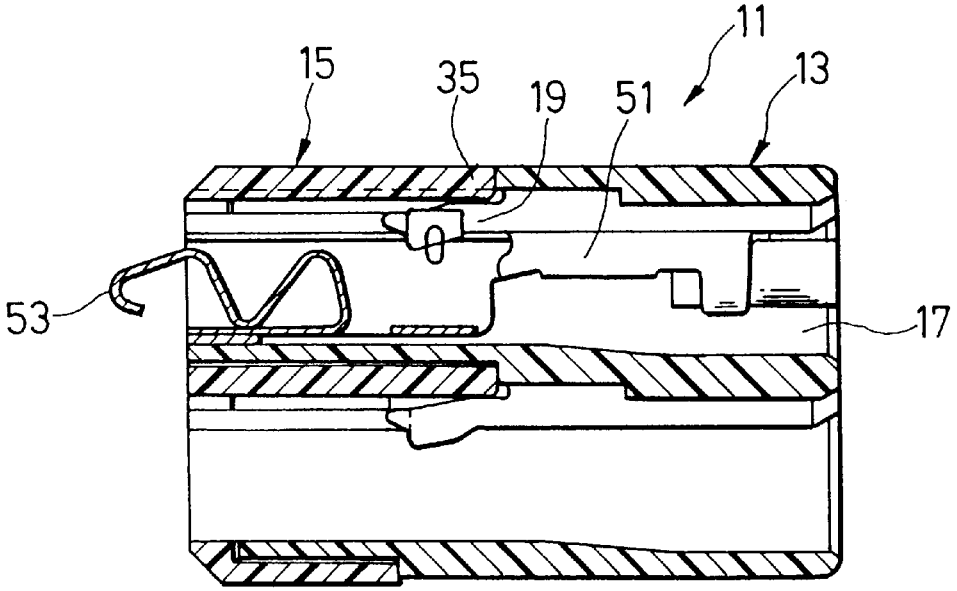
FIG. 13 is a view as seen along the line XIII—XIII of FIG. 12.

At this time, the housing 13 is pushed out of the front end of the spacer 15, so that the contact 53 of each terminal 51 is projected from the front end of the opposed-contact connector 11, as shown in FIG. 13.

Figure 14:
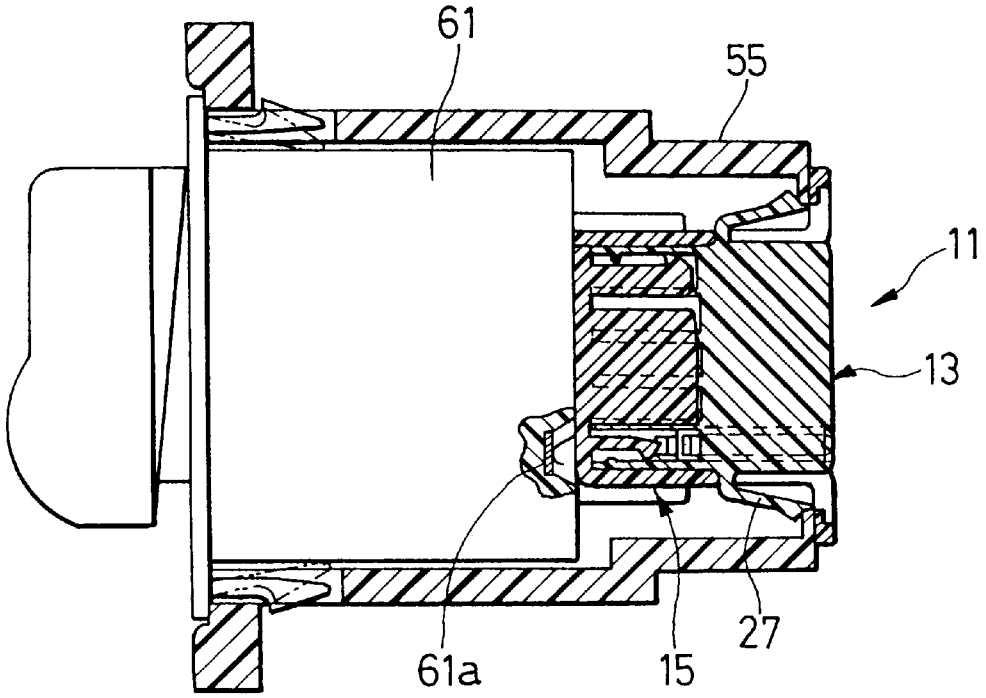
FIG. 14 is a cross-sectional view showing the opposed-contact connector connected to a mating part.
Figure 15:
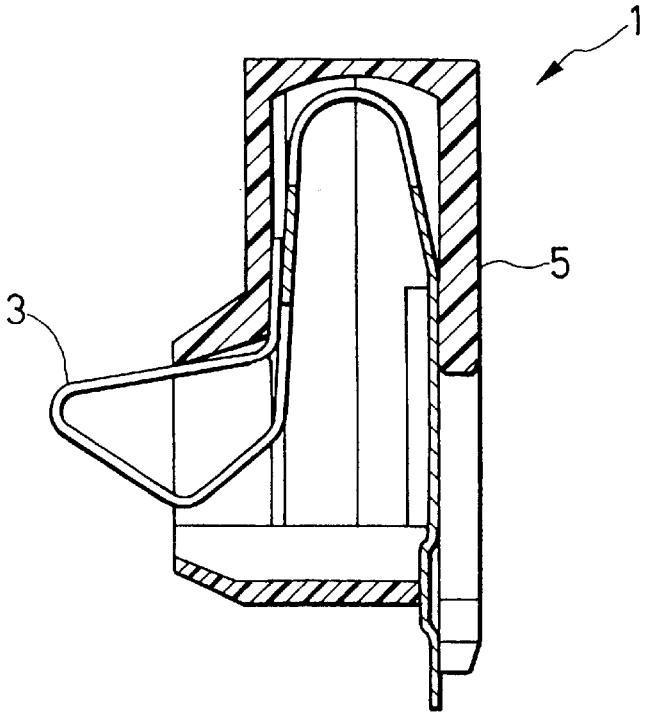
FIG.15 PRIOR ART
FIG. 15 is a cross-sectional view of a conventional opposed-contact connector.
Figure 16:
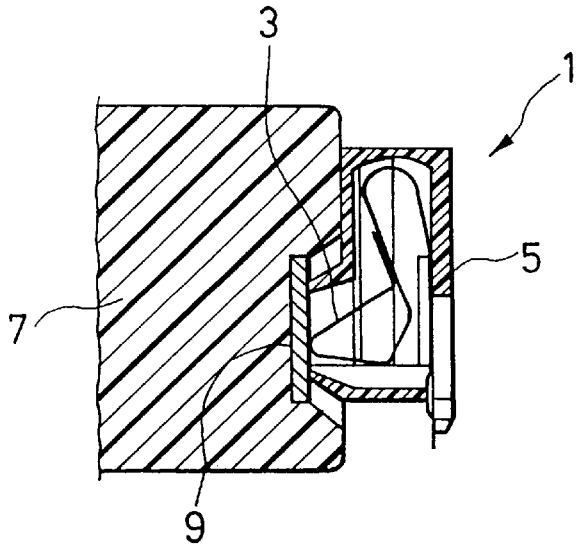
FIG.16 PRIOR ART
FIG. 16 is a cross-sectional view showing a condition in which the opposed-contact connector of FIG. 15 is electrically contacted with a battery.

In this condition, an electric part 61 is mounted on the instrument panel 55, and the terminal contacts 53 are electrically contacted respectively with electrodes 61*a* of the electric part 61 under a pressure, as shown in FIG. 14.

In the provisionally-retained condition of the opposed-contact connector 11 before it is mounted on the instrument panel 55, the projections 31 of the elastic legs 27 are engaged respectively with the stoppers 43 of the fixing legs 37, and the spacer 15 is retained on the housing 13 in such a manner that the spacer 15 projects from the front end of the housing 13. Therefore, the terminal contacts 53, projecting from the housing 13, are covered with the spacer 15, and are prevented from interfering with other member.

Accordingly, the contacts 53 are prevented from deformation due to interference by the other member, corrosion due to adherence of the hand grease, dirt and so on thereto, and incomplete contact, and even when a relatively high voltage is applied, adverse effects on the human body upon contact are prevented since the terminals 51 are not projected.

During the process from the provisional attachment to the provisionally-retained condition, the insertion plate 35 of the spacer 15 is inserted into the receiving portion 21 of the housing 13, and with this construction if the terminal 51 is incompletely retained, the lance 19 prevents the advance of the insertion plate 35, thereby preventing the sliding movement of the spacer 15, and therefore the incomplete retaining of the terminal 51 can be detected.

As described in detail, in the opposed-contact connector of the present invention, the spacer is slidably mounted on the front portion of the housing, and the spacer provisionally-retaining device is provided between the spacer and the housing, and before the housing is mounted on the mounting member, the spacer is provisionally retained on the housing by said retaining device in such a manner that the spacer encloses the contacts, and when mounting the housing on the mounting member, the retaining device releases the provisionally-retained condition, and allows the spacer to slide. Therefore, in a normal condition, the terminals are covered with the spacer, and the terminals, projecting from the housing, are prevented from interfering with the other member. Accordingly, the deformation of the terminals is prevented, and the reliability of the electrical contact, as well as the safety, can be enhanced.

What is claimed is:

1. An opposed-contact connector, comprising:

a housing attachable to a mounting member;

a terminal insertable into said housing and retainable at a position in which a contact of said terminal projects beyond a front portion of said housing;

a spacer slidably mounted on said front portion of said housing to enclose said contact; and a retaining device for retaining said spacer to said housing, wherein, before mounting said housing on said mounting member, said spacer is provisionally retained on said housing by said retaining device so that said spacer encloses said contact, and wherein when said housing is mounted on said mounting member, said retaining device is releasable to allow said spacer to move from said provisionally-retained condition to a completely retained condition whereat said contact projects beyond both said spacer and said front portion of said housing.

2. The opposed-contact connector of claim 1, further comprising:

a terminal receiving chamber, for receiving said terminal, formed in said housing;

an elastic retaining piece portion formed in said terminal receiving chamber for retaining said terminal;

an insertion plate projected from said spacer; and a plate receiving portion formed in said housing for receiving said insertion plate, said plate receiving portion serving as a retraction space for receiving said elastic retaining piece portion.

3. The opposed-contact connector of claim 1, wherein said retaining device includes:

a pair of elastic legs formed on opposite side walls of said housing, respectively; and a pair of fixing portions formed on opposite sides of said spacer, respectively, said legs engageable with said fixing portions.

4. The opposed-contact connector of claim 3, wherein said legs each has a fixing pawl and a projection formed on a distal end portion of each of said legs, said fixing portions each has a frame portion having a through hole into which one of said legs is insertable and a stopper portion formed to narrow a width of said through hole, said stopper portion being engageable with said projection.

5. The opposed-contact connector of claim 1, wherein said housing includes a first retaining pawl and a second retaining pawl which are formed respectively on opposed inner surfaces of said housing, said spacer includes a third retaining pawl and a fourth retaining pawl formed on said spacer, and wherein said first retaining pawl and said second retaining pawl are engageable respectively with said third retaining pawl and said fourth retaining pawl.

6. The opposed-contact connector of claim 1, wherein said spacer circumscribes said front portion of said housing.

* * * * *